US006649282B1

(12) United States Patent
Yamaguchi et al.

(10) Patent No.: US 6,649,282 B1
(45) Date of Patent: Nov. 18, 2003

(54) SURFACE TREATED STEEL PRODUCT PREPARED BY TIN-BASED PLATING OR ALUMINUM-BASED PLATING

(75) Inventors: Shinichi Yamaguchi, Kitakyushu (JP); Jun Maki, Kitakyushu (JP); Teruaki Izaki, Kitakyushu (JP); Masao Kurosaki, Futtsu (JP); Hisaaki Sato, Kitakyushu (JP); Hidetoshi Shindo, Himeji (JP); Seiji Sugiyama, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/937,007

(22) PCT Filed: Mar. 17, 2000

(86) PCT No.: PCT/JP00/01680

§ 371 (c)(1),
(2), (4) Date: Dec. 26, 2001

(87) PCT Pub. No.: WO00/56945

PCT Pub. Date: Sep. 28, 2000

(30) Foreign Application Priority Data

| | | |
|---|---|---|
| Mar. 19, 1999 | (JP) | 11-076431 |
| Apr. 2, 1999 | (JP) | 11-096299 |
| Jun. 29, 1999 | (JP) | 11-182970 |
| Sep. 14, 1999 | (JP) | 11-260468 |

(51) Int. Cl.[7] ..... B32B 15/00

(52) U.S. Cl. ..... 428/648; 428/621; 428/626; 428/628; 428/630; 428/646; 428/650; 428/653; 428/926; 428/933; 428/939

(58) Field of Search ..... 428/648, 646, 428/650, 653, 621, 626, 628, 630, 926, 933, 939

(56) References Cited

U.S. PATENT DOCUMENTS

| | | | | |
|---|---|---|---|---|
| 3,026,606 A | | 3/1962 | Nickola | 428/650 |
| 4,401,727 A | * | 8/1983 | Berke et al. | 428/650 |
| 5,491,035 A | * | 2/1996 | Carey, II et al. | 428/648 |

FOREIGN PATENT DOCUMENTS

| | | |
|---|---|---|
| EP | 0 763 608 | 3/1997 |
| JP | 56-127762 | 10/1981 |
| JP | 02-270951 | 11/1990 |
| JP | 3-21627 | 3/1991 |

OTHER PUBLICATIONS

Keikinzoku Gakkai, "Aluminum Structure and Properties", p. 15, 1991. (no month given)

* cited by examiner

*Primary Examiner*—Robert R. Koehler
(74) *Attorney, Agent, or Firm*—Kenyon & Kenyon

(57) ABSTRACT

A tin-plating or aluminum-plating surface treated steel material with excellent corrosion resistance containing an intermetallic compound composed of one or more Group IIa (alkaline earth metal) elements and one or more Group IVb elements in a tin-based plating layer or aluminum-based plating layer on the surface of a steel material. For a tin-based plating layer, the long diameter of the intermetallic compound massive bodies is 1 82 m or greater and the short diameter/long diameter ratio is at least 0.4. For an aluminum-based plating layer, the long diameter of the intermetallic compound massive bodies is 10 $\mu$m or greater and the short diameter/long diameter ratio is at least 0.4.

12 Claims, 2 Drawing Sheets

SURFACE TREATED STEEL PRODUCT PREPARED BY TIN-BASED PLATING OR ALUMINUM-BASED PLATING

TECHNICAL FIELD

The present invention relates to a surface treated steel material with excellent corrosion resistance, to be used for outer plates, exhaust system members and gasoline tank materials of automobiles, metal construction materials for roofs and walls, public works materials, and home and industrial electrical appliances.

BACKGROUND ART

Zn, Zn—Al, Al—Si, Sn, Pb—Sn, Cr and Ni platings are among platings used for surface treated steel materials, and because of their excellent corrosion and heat resistance and attractive outer appearance, they have come into wide use for automobile members, construction materials, electrical appliances and container materials. The most commonly used platings are Zn and Zn—Al platings. This is because Zn is the only plating metal with a sacrificing protection property to prevent corrosion of exposed iron when the basis iron is exposed. However, the relatively high corrosion rate of the Zn plating itself is a problem. With a Zn—Al system, the plating corrosion rate is lower but the sacrificing anti-corrosion action for iron is weaker. Elements that improve the corrosion resistance of the Zn plating itself generally tend to impair the sacrificing anti-corrosion effect, and therefore the corrosion resistance of the plating itself and the anti-corrosion for iron facings are in an antimonious relationship.

Sn platings, Al—Si platings and the like that exhibit excellent corrosion resistance as platings themselves all lack protective action on basis iron exposed in normal environments.

The following is an example of such a plating for protection of exposed basis iron. Specifically, U.S. Pat. No. 3,026,606 describes hot-dip aluminum plating of iron articles in an aluminum bath containing Mg and Si in a stoichiometric relationship in order to obtain $Mg_2Si$ up to 25% in the plating layer. According to this patent, it is indeed possible to achieve improvement in corrosion resistance by crystallization of $Mg_2Si$ in the aluminum plating layer. However, when Mg is added to the plating bath in excess of 10%, oxidation of the Mg causes highly profuse production of an oxide film on the plating bath, thus making continuous production impossible. Based on investigation by the present inventors, crystallization of $Mg_2Si$ in an aluminum plating layer has been found to alter the form from fine to coarse, and thus notably influence the corrosion resistance.

Japanese Examined Patent Publication HEI No. 3-21627 discloses an Al—Zn—Si—Mg quaternary alloy plating containing dendritic crystals composed mainly of aluminum and zinc. While it is indeed possible to adequately protect exposed iron with a crystallized plating of dendritic crystals composed mainly of aluminum and zinc, the Zn is added in an amount of 25% or greater, which impairs the corrosion resistance of the plating itself.

It is an object of the present invention to provide plated steel sheets exhibiting both high corrosion resistance of the plating itself and a protective effect on exposed basis iron in a continuous production process, which had been considered impossible to simultaneously achieve

DISCLOSURE OF THE INVENTION

According to the present invention there has been successfully achieved a surface treated steel material based on a completely different concept unlike the conventional concept of protection of basis iron by sacrificing anti-corrosion action and plating base metal corrosion product coating action.

It is known in the prior art that corrosion resistance is improved by the coating action of stabilized corrosion products obtained by addition of Mg to Zn-based platings. As a result of repeated diligent study on ways of exhibiting the corrosion inhibitor effect of Mg even in Al-based and Si-based platings as well as Zn-based platings, the present inventors have completed the present invention upon finding that by including Mg in the plating as a water-soluble intermetallic compound ($Mg_2Sn$ or $Mg_2Si$) in the form of massive bodies of consistent sizes, the intermetallic compounds elute out from the plating coat by contact with water in a corroding environment and form an anti-corrosion film composed mainly of Mg hydroxide, thus allowing a notable improvement in the plating corrosion resistance.

As a result of searching for elements with anti-corrosion action in addition to Mg, it was found that elements of the same Group as Mg, Group IIa of the Periodic Table (alkaline earth metals), exhibit an anti-corrosion corrosion effect. The anti-corrosion effect is most with Mg and Ca among the alkaline earth metals.

Intermetallic compounds are generally considered to be poorly soluble in water, but combinations of elements with a large difference in potential negativity are water-soluble. Much research has been conducted on electronegativities of elements, but here we will rely on the values from the research by Pauling. Intermetallic compounds composed of elements having a minimum/maximum electronegativity ratio of 0.73 or lower are soluble in water. The electronegativities of alkaline earth metals are generally low and intermetallic compounds containing these elements are readily soluble in water, but upon examining solubilities in water, it was found that intermetallic compounds composed of alkaline earth metals and Group IVb elements have considerably high solubilities in water. The most preferred Group IVb elements that form intermetallic compounds with Mg and Ca are Si and Sn, because of their electronegativities.

BEST MODE FOR CARRYING OUT THE INVENTION

Figure 1:
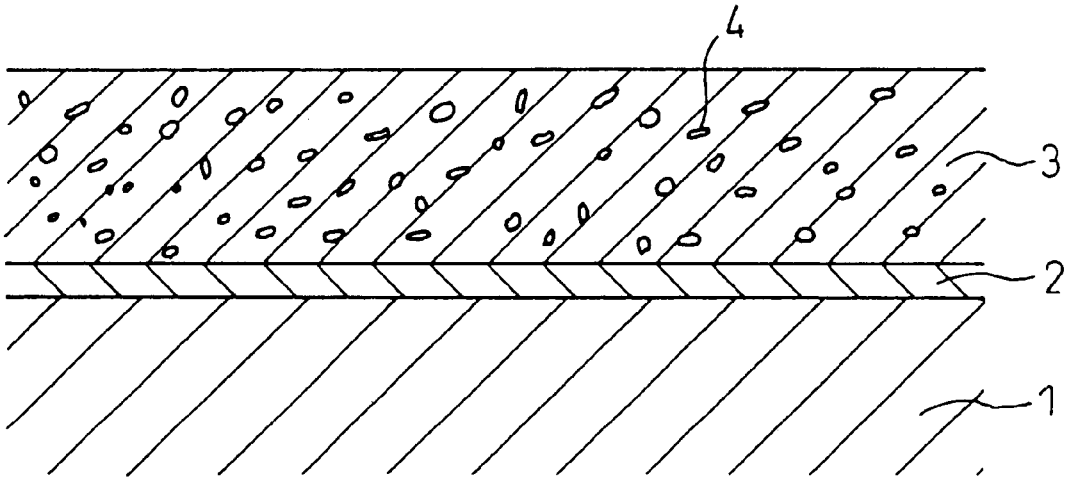
FIG. 1 is a schematic cross-sectional view of a tin-plating or aluminum-plating surface treated steel material with excellent corrosion resistance according to the invention, where the surface of the basis iron 1 has a tin-plating or aluminum-plating layer via a layer 2 of an alloy between the basis iron and the plating metal, and there are dispersed in the plating layer 3 massive bodies 4 of an intermetallic compound composed of a Group IIa (alkaline earth metal) and Group IVb element.

The present invention will now be explained in further detail.

In most hot-dip platings, an alloy layer is produced which is an intermetallic compound layer comprising Fe and the plating metal, referred to as an alloy layer, at the interface between the plating layer and the basis iron. The "intermetallic compound" of the invention is different and refers to an intermetallic compound present in the plating layer. Also, the "plating layer" mentioned here (throughout the specification and in the claims) refers to the layer that does not include the layer produced at the interface between the plating layer and the basis iron, and a clear distinction is made between the plating layer and the alloy layer.

According to the invention, sufficient corrosion resistance may be achieved by the presence of an intermetallic compound comprising a Group IIa and Group IVb element in the plating layer, in the case of an Sn plating layer, and the intermetallic compound is preferably present in the plating layer in the form of massive bodies that are localized at specific sites In the case of an Al plating layer, the intermetallic compound comprising the Group IIa and Group IVb elements must be present in the form of massive bodies.

According to the invention, the intermetallic compound comprising the Group IIa and Group IVb elements dissolve and elute out in water in corrosive environments, forming an anticorrosion film on the plating layer or basis iron. Formation of this anticorrosion film requires dissolution of a fixed amount of the intermetallic compound in the corrosive environment. With plating layers in which the intermetallic compound is finely diffused, the metal itself composing the plating layer must also corrode to some extent until the fixed amount of the intermetallic compound dissolves. Formation of the anticorrosion film by the initial corrosion is therefore difficult to accomplish. Particularly when the plating is of Al or Sn which themselves are metals with excellent corrosion resistance, the anticorrosion film forms later, and furthermore, since the Al and Sn themselves exhibit no sacrificing anticorrosion function, the anticorrosion effect against the basis iron is notably lacking. In contrast, when the intermetallic compound is diffused in the plating layer in the form of massive bodies, the intermetallic compound can be present in a sufficient amount to form an anticorrosion film even near the surface of the plating, and therefore, the Mg or Ca with the anticorrosion action are adequately released into the environment upon the initial corrosion, thus allowing formation of an anticorrosion film on the plating layer and basis iron. Particularly in the case of an Al plating, the Group IIa element supplied from the intermetallic compound tends to adsorb onto the Al plating surface, so that a Group IIa element-based anti-rust film is formed on the plating surface as well. Consequently, in order to guarantee an amount of the Group IIa element required for formation of an anti-rust film on the basis iron, more of the Group IIa element (as the intermetallic compound) is necessary than in the case of an Sn plating with low adsorption on the plating surface. With an Al plating, therefore, it is essential for the intermetallic compound comprising a Group IIa and Group IVb element to be present in the plating layer in the form of massive bodies.

Furthermore, since the intermetallic compound is usually harder than the plating layer, working will produce cracks in the plating layer starting particularly from the intermetallic compound massive bodies, and since dissolution of the intermetallic compound will commence from those points, the presence of the intermetallic compound in the plating layer in the form of massive bodies will also give vastly superior corrosion resistance to the worked sections.

Moreover, the elements forming the intermetallic compound are at least one element of Group IIa (alkaline earth metals) and at least one element of Group IVb. As mentioned above, this is because the solubility of the intermetallic compound in water will thereby be notably increased. Preferred alkaline earth metals are Mg and Ca, because of their notable corrosion inhibitor effects on metals. Si and Sn are examples of Group IVb elements that form water-soluble intermetallic compounds with these alkaline earth metals. Compounds produced by thee elements are especially recommended. More preferred are $Mg_2Si$ and $Mg_2Sn$. Intermetallic compounds comprising Group IIa and Group IVb elements are not limited to binary systems, but also naturally include ternary and greater systems.

The present invention is characterized by having a plating layer in which there is diffused an intermetallic compound with a large corrosion inhibitor effect, wherein at least a portion of the intermetallic compound is in the form of massive bodies. The "massive bodies" are relatively coarse with a small difference between long diameter and short diameter, and the structure thereof is confirmed by inclined cross-section. According to the invention, a "massive crystal" is defined as one where the long diameter of the intermetallic compound is at least 1 $\mu$m for an Sn-based plating and at least 10 $\mu$m for an Al-based plating, and a ratio of the short diameter to long diameter is at least 0.4, as observed by a 50 inclined cross-section (polishing at an angle of 5° with respect to the surface of the steel sheet). Here, the short diameter and long diameter are the longest dimension (diameter) and shortest dimension (diameter) of a given crystal. Polishing alone, with no etching, is used for the observation. These intermetallic compounds are water-soluble and also dissolve very easily in etching solutions.

The intermetallic compound may be identified, for example, by X-ray diffraction or EPMA analysis, but there is no limitation to these. The cross-sectional structure may be observed with an optical microscope, a SEM, or the like, to examine the intermetallic compound on a structural level. The structure of the intermetallic compound is determined by the characteristic X-ray image by EPMA, or by quantitative analysis. Approximately 5° inclined polishing is preferred for the structure observation, as this allows easy observation of the structure with an optical microscope. EPMA analysis may be carried out with vertical polishing and inclined polishing, but the analysis must be made without etching. The major components of the intermetallic compound may be identified by X-ray diffraction. However, when the amount of the intermetallic compound is low compared to the plating layer, EPMA and structural observation must be carried out together since the detection sensitivity is too low with X-ray diffraction. Intermetallic compounds such as $Mg_2Si$ can also be identified by structure using an optical microscope. For example, the etching properties of different metals and intermetallic compounds containing $Mg_2Si$ in various corroding solutions have been elucidated, as described in "Aluminum Structure and Properties" (Keikinzoku Gakkai, ed., 1991), p.15, Table 4, and therefore various etching solutions can be used to identify $Mg_2Si$ based on structural observation.

Also, in order to obtain $Mg_2Si$ or $Mg_2Sn$ and $Ca_2Si$ or CaSi in the form of massive bodies necessary to achieve stable corrosion resistance, the cooling rate of the plated steel sheet must be controlled in the strip coding section. With conventional Al-Si based platings, the cooling rate in the strip cooling section must be at least 20° C./sec for refinement of the needle-like Si crystals in the plating layer that are a cause of reduced corrosion resistance and workability. In the plating of the invention, with a cooling rate of 20° C./sec or higher the $Mg_2Si$ or $Mg_2Sn$ and $Ca_2Si$ or CaSi massive bodies become fine and corrosion resistance cannot be adequately exhibited from the edges or facings. The cooling conditions are therefore preferably below 20°

C./sec, and more preferably 3–15° C./sec. In particular, the $Mg_2Si$ massive bodies crystallize as the initial crystals upon aggregation of the hot-dip plating components, and it is important to slowly cool from the $Mg_2Si$ crystallization temperature (which differs depending on the plating bath composition) to near the eutectic temperature. The amount of crystallization for an aluminum-based plating is preferably from 5 to 40 $Mg_2Si$ massive bodies with a long diameter of 10 μm or greater, in a field of 1 mm plating width with a 5° inclination cross-section. For a tin-based plating, it is preferably from 3 to 50 $Mg_2Sn$ and $Mg_2Si$ massive bodies with a long diameter of 1 μm or greater, in a field of 1 mm plating width with a 5° inclination cross-section. If the amount of crystallization is too low it will not contribute significantly to corrosion resistance, and if it is too high it may adversely affect the workability, while those sections may dissolve tending to result in a plating layer with abundant defects.

The main plating metal types according to the invention are those composed of Al and Sn. The invention gives a protective effect on basis iron to Al and Sn platings that have conventionally been thought to lack a protective effect on basis iron, despite the excellent corrosion resistance of the platings themselves. In addition, for uses particularly requiring edge anti-rust properties over long periods, it is preferred to select plating types containing small amounts of Zn. The plating method of the invention is not particularly restricted, and hot-dip plating, vacuum deposition and the like may be employed. However, hot-dip plating is most preferred considering that the present invention will achieve active use of the intermetallic compound and crystallize the intermetallic compound by aggregation of the hot-dip components.

The plating layer components of the invention will now be explained. Here, the concentrations of each of the elements include the plating layer and the intermetallic compound diffused throughout the plating layer.

When Sn is selected as the main plating metal, the plating layer components are included, in terms of weight percentage, with either or both Mg and Ca in ranges of Mg: 0.2–10%, Ca: 0.01–10%, optionally with Al at 0.01–10%, with the remainder Sn and unavoidable impurities, while having an intermetallic compound composed of a Group IIa element and Group IVb element in the plating layer. It is also effective to add Zn at 1–40% and/or Si at 0.1–0.5%. The Group IIa elements Mg and Ca form the intermetallic compounds $Mg_2Sn$ and $Ca_2Sn$ with the Group IVb element Sn, which contribute to corrosion resistance. The effect of improved corrosion resistance is active with at least 0.2% of both Mg and Ca, while at greater than 10% the melting point increases and a Mg oxide film is rapidly produced, thus impairing the manageability. Since $Mg_2Sn$ readily takes the form of a diffused compound, there are no particular restrictions on the form of the intermetallic compound in the Sn-based plating, but, as observed with a 5° inclination cross-section the long diameter of the intermetallic compound is preferably at least 1 μm and the proportion of the short diameter to the long diameter is preferably at least 0.4, as observed with a 5° inclination cross-section. More preferably, the long diameter of the intermetallic compound is at least 3 μm and the proportion of the short diameter to the long diameter is at least 0.4, Addition of Al and Ca inhibits oxidation of Mg and is effective for obtaining a satisfactory outer appearance, for which purpose it is effective to add Al in an amount of at least 0.01% and preferably at least 0.2%, and Ca in an amount of at least 0.01% and more preferably at least 0.2%, considering the desired improvement in corrosion resistance; however, at over 10% the melting point rises, thus impairing the manageability. When Zn is further added to Sn the Zn provides a sacrificing anticorrosion effect, which effect is exhibited with addition of at least 1%, and because an amount of greater than 40% increases the solubility of the plating layer, the upper limit is preferably 40%, and more preferably 20%. Addition of Si results in production of $Mg_2Si$ and $Ca_2Si$ and improves the corrosion resistance, and it is therefore added to at least 0.1%. At greater than 0.5% the melting point rises, thus impairing the manageability.

When Al is selected as the main plating metal, the plating layer contains intermetallic compound massive bodies composed of a Group Ia element and Group IVb element. It is preferred for the long diameter of the intermetallic compound massive bodies to be at least 10 μm and the proportion of the short diameter to the long diameter to be at least 0.4, in order to achieve stable corrosion resistance. More preferably, the long diameter of the intermetallic compound is at least 15 μm and the proportion of the short diameter to the long diameter is at least 0.4. The plating layer components are preferably included, in terms of weight percentage, with either or both Mg and Ca in ranges of Mg: 2–10%, Ca: 0.01–10%, and with Si: 3–15%, with the remainder Al and unavoidable impurities. Si is known as an element that inhibits growth of metal plating layers, and it exhibits its effect when added to at least 3%, and preferably over 6%. However, if added in large excess it raises the melting point of the plating bath resulting in excessive growth of the alloy layer, which has been implicated as a cause of reduced workability, and therefore the upper limit for Si is 15%.

Mg improves the corrosion resistance when added at 2% or greater, and it is preferably added at 4% or greater. The present invention forms $Mg_2Si$ massive bodies in the aluminum plating layer, and the Mg/Si ratio of the plating layer is preferably slightly lower than 1.73 equivalents of $Mg_2Si$. When the Mg/Si ratio is in the range of 1.70 or lower, the plating layer becomes a ternary eutectic composition of Al—$Mg_2Si$—Si, which provides the maximum corrosion resistance. This is conjectured to result from the fact that the melting point is lowest within this range, such that the alloy layer growth is inhibited and the amount of the plating layer contributing to corrosion resistance is substantially increased. However, excessive addition raises the melting point of the plating bath, resulting in excessive growth of the alloy layer, which has been implicated as a cause of reduced workability, and rapid production of an Mg oxide film; the upper limit for Mg is therefore 10%.

Ca is also preferably added to at least 0.01% in the plating layer. This is because Ca inhibits oxidation of Mg in the molten metal during hot-dip plating, thus preventing defects in the outer appearance. When plating is carried out in air without addition of Ca, a severe wrinkled pattern is produced on the plating surface which lowers the product value, such that means for inhibiting the molten metal portions in a low oxygen atmosphere is necessary, thus requiring investment for equipment. The Mg oxidation-inhibiting effect of the Ca addition is saturated at 0.2%. When Ca is added in a greater amount it also reacts with Si forming $Ca_2Si$, CaSi and the like, providing an anticorrosion effect similar to that of $Mg_2Si$. When Ca is added, the (Ca+Mg)/Si mass ratio is preferably no greater than 2.8 to cause crystallization of the $Mg_2Si$ and $Ca_2Si$, CaSi in the plating layer. However,.excessive addition of Ca raises the melting point of the plating bath resulting in excessive growth of the alloy layer, which has been implicated as a cause of reduced workability, and therefore the upper limit for Ca is 10%.

Addition of Zn also provides a sacrificing anticorrosion effect by the Zn. This effect is exhibited with addition of 2% or greater, but at greater than 25% the solubility of the plating layer increases and therefore the upper limit is preferably 25%. More preferred is a lower limit of 10% and an upper limit of 20%.

In addition to Ca, Be is another element effective for inhibiting oxidation of Mg in any Al-based or Sn-based plating type, but because Be is a toxic element its application is highly undesirable.

The thickness of the plating layer is preferably 2–100 μm. For most plating layers, increasing thickness is advantageous for corrosion resistance, and disadvantageous for workability and weldability. The preferred thickness for the plating layer will therefore differ depending on the use, and while a thinner plating layer is better for automobile parts that require excellent workability and weldability, sufficient corrosion resistance cannot be guaranteed at less than 2 μm, and therefore the thickness is preferably at least 2 μm. On the other hand, for construction materials and household appliance uses that do not demand particular workability or weldability, a larger plating layer thickness is better from the standpoint of improved corrosion resistance, but because of the drastically inferior workability at thicknesses exceeding 100 μm, it is preferably no greater than 100 μm. The present invention is also effective for frame and running automobile parts. Arc welding is usually employed for frame and running automobile parts, but in the case of Zn-based platings the high vapor pressure of the Zn has tended to produce blowholes. Al-based and Sn-based platings that have low vapor pressure would be normally preferred, but such platings have not come into use because of their weak protective effect on basis iron. According to the invention, even such highly corrosion-resistant platings have a protective effect on basis iron, and offer the additional advantage of producing no blowholes during arc welding.

The roughness of the plating surface affects the outer appearance, corrosion resistance, weldability and workability. A high roughness is advantageous for workability, but disadvantageous for weldability and corrosion resistance. The optimum value will therefore differ depending on the type of plating and its intended use, but it is preferably 3 μm or lower in terms of Ra.

All Al-based and Sn-based plated steel materials produce alloy layers at the interface between the plating layer and the basis iron. The thickness is about 0.1–1 μm in the case of Sn-based platings that have a low melting point, and reaches 0.5–5 μm in the case of Al-based platings. Because the thickness of the alloy layer has a particularly large influence on the workability and post-working corrosion resistance in the case of an Al-based plating, the thickness of the alloy layer is preferably no greater than 5 μm.

For improved corrosion resistance, a thinner alloy layer and improved plating wettability, it is preferred to form a pre-plating containing one or more from among Ni, Co, Zn, Sn, Fe and Cu at the interface with the plating layer and the basis iron, as treatment prior to plating. The Al or Sn is hot-dip plated after the pre-plating, or in the case of heat treatment, an alloy layer is formed between the pre-plating layer and the basis iron, or between the pre-plating layer and the plating layer. The pre-plating layer and alloy layer may also be formed as a mixed layer, and the gist of the invention is not impaired regardless of the state. The pre-plating is sometimes dissolved in the plating bath, or the pre-plating components are sometimes included in the plating layer or steel sheet by diffusion, and this will also not impair the gist of the invention.

The constituent elements of the plating are basically the main plating metal and intermetallic compound-forming elements and unavoidable impurities, but if necessary Bi, Sb, Fe, misch metal, Be, Cr, Mn or the like may also be added.

By using a post-treatment coating such as a chemical treatment coating or resin coating on the uppermost surface of the plating layer, an effect of improved weldability, coating cohesion and corrosion resistance may be expected. As chemical treatment coatings there may be used chromic acid/silica-based coatings, silica/phosphoric acid-based coatings, silica/resin-based coatings and the like, and as resin coatings there may be used acrylic-based, melamine-based, polyethylene-based, polyester-based, fluorine-based, alkyd-based, silicon polyester-based and urethane-based resins as well as other common resins. There are no particular restrictions on the film thickness, but treatment may usually be carried out to 0.2–20 μm. Inhibitors using no chrome are recently being investigated as post-treatment, and such treatment may of course be used.

The steel components of the basis metal will now be explained. There are no particular restrictions on the steel components, and an improving effect on corrosion resistance is exhibited for any type of steel; the steel type may be IF steel, Al-killed steel, Cr-containing steel, stainless steel, high-tension steel, etc. to which Ti, Nb, B or the like has been added. Al-k steel or stainless steel is preferred for construction uses, Ti—IF steel is preferred for exhaust systems, Al-k steel is preferred for household appliances, B-added IF steel is preferred for fuel tanks, and electromagnetic steel sheets are preferred for magnetoelectric shields.

EXAMPLES

The present invention will now be explained in greater detail by way of the following examples.

Example 1

Hot-dip tin plating was performed using as the material a cold-rolled steel material (sheet thickness: 0.8 mm) with the steel components shown in Table 1, which had been subjected to normal hot rolling and cold rolling steps.

First, a Ni plating was formed to about 1 g/m$^2$ by an electroplating method using a Watt bath. A flux method was then used for tin plating. After plating, the plating coverage was adjusted by gas wiping. The plated steel sheet was then cooled and rolled up.

Plating was then carried out with appropriate variations in the amounts of Mg, Ca and Al in the plating bath composition. Also included as unavoidable impurities from the plating instruments and stripping in the bath were Fe and Ni, at no greater than 0.05% each in the plating bath. The bath temperature was 260–300° C.

The outer appearance of the platings were satisfactory with no non-plated sections, but severe oxidation on the bath surface was observed depending on the bath composition. The plating coverage was uniform on both sides, at about 60 g/m$^2$ on both sides, and the surface roughness was 0.9–1.4 μm in terms of Ra.

Figure 2:
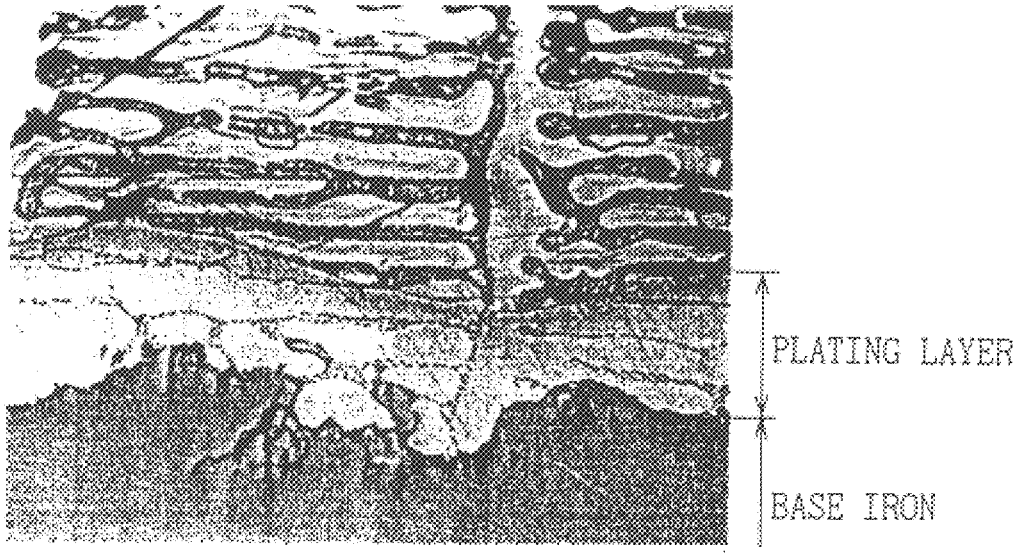
FIG. 2 is an illustration showing a 5° inclined cross-sectional structure of a Sn-1% Mg-0.005% Ca-plated steel sheet.

FIG. 2 shows a photograph (200×) of the 50° inclined cross-sectional structure of the plating layer of a plated sample using a Sn-1% Mg-0.01% Ca bath. The $Mg_2Sn$ granular phase is shown diffused in the plating, and the presence of this compound was also confirmed by X-ray diffraction. In the photograph of FIG. 2, the lower gray portion is the cross-section of the basis iron, and the upper portion with the thick linear pattern is the surface of the plating layer (plan view); the white (light gray) portion at the intermediate region is the cross-section (50° inclined cross-section) of the plating layer. The granular intermetallic compound ($Mg_2Sn$) is seen present as groups of black lined dots in the 50° inclination cross-section of the white plating layer.

A pure Sn-plated steel sheet and a Pb-8% Sn-plated steel sheet were also manufactured for comparison. Both were plated after Ni pre-plating. The plated steel sheets contained no intermetallic compounds in the plating layers. Their performance was evaluated by the tests described below.

TABLE 1

| Steel components of test materials (wt %) | | | | | | | | | |
|---|---|---|---|---|---|---|---|---|---|
| C | Si | Mn | P | S | Ti | Al | N | Nb | B |
| 0.0012 | 0.02 | 0.22 | 0.007 | 0.010 | 0.05 | 0.03 | 0.002 | 0.004 | 0.0005 |

(1) Plating Layer Analysis

[1] Plating Layer Composition Analysis Method

Both sides of a 50×50 sample were subjected to electrostripping in a 5% NaOH solution (wt %) at a current density of 10 mA/cm$^2$, using stainless steel as the counter electrode. Upon abrupt increase in the potential, the current density was gradually reduced to half, and then eventually reduced to 1 mA/cm$^2$, and electrolysis was suspended when the potential of the Ni layer or alloy layer was exhibited The scrap adhering to the steel sheet was gently wiped with absorbent cotton, and the analysis solution was sampled together with it.

The analysis solution was then filtered and the undissolved scrap was dissolved in 10% hydrochloric acid. The filtrate and solution were combined and subjected to quantitative analysis by ICP (inductively coupled plasma) emission spectroscopy.

Because error due to Cr, Si, etc. can occur when a is steel sheet is subjected to chemical treatment, the stripping may be carried out after light paper polishing of the surface.

[2] Plating Composition Observation Method

The plating layer cross-section was polished at a 5° inclination, and the plating composition was observed (200–500×) with an optical microscope. The long diameter and number of the intermetallic compounds (long diameter/short diameter ratio ≧0.4) in the plating layer were measured within a 1 mm width (arbitrary) field of the plating.

(2) Corrosion Resistance

[1] Salt Injury Corrosion Resistance

After cross-cutting a 70×150 mm sample, a salt spray test was carried out according to JIS Z2371 and the time until generation of red rust was evaluated.

Evaluation Scale

○: red rust generated after 20 days

Δ: red rust generated at 10–20 days

X: red rust generated within 10 days

[2] Post-painting Corrosion Resistance

A 70×150 mm sample was subjected to chromic acid/silica chemical treatment to about 20 mg/m$^2$ in terms of metal Cr, and then to painting with melamine-based black paint to 20 μm, followed by 20 minutes of baking at 140° C. This was then cross-cut and provided for a salt spray test. The outer appearance after 60 days was visually evaluated.

Evaluation Scale

◎: no red rust generation

○: no red rust generation other than from cross-cut

Δ: red rust generation of ≦5%

X: red rust generation of >5%

[3] Fuel Corrosion Resistance

The corrosion resistance against gasoline was evaluated. The method involved placing a test solution in a sample subjected to deep drawing with a flat-bottomed cylinder having a 20 mm flange width, 50 mm diameter and 25 mm depth with a hydraulic molding tester, and capping it with glass via a silicon rubber ring. The state of corrosion after the test was visually observed.

Test Conditions

Test solution: gasoline+10% distilled water+200 ppm formic acid

Test period: standing for 3 months at 40° C.

Evaluation Scale

○: red rust generation of <0.1%

Δ: red rust generation of 0.1–5% or white rust

X: red rust generation of >5% or considerable white rust

[4] Outdoor Exposure Test

Coating was carried out after chemical treatment. The coating was with two types of epoxy-based resins (20 μm). The sample was sheared to dimensions of 50×200 nm and subjected to an outdoor exposure test. After the course of one month, the generation of red rust from the edges and the condition of discoloration of the surface were evaluated.

Evaluation Scale

○: red rust generation of >30% from edges

Δ: red rust generation of 30–80% from edges

X: red rust generation of >80% from edges (3) weldability

Spot welding was performed under the welding conditions indicated below, and the number of continuous weld points up to the time at which the nugget system cleared 4 $\sqrt{t}$ (t=sheet thickness) was evaluated.

Welding Conditions welding current: 10 kA
Pressure force: 220 kg
Welding time: 12 cycles
Electrode diameter: 6 mm
Electrode shape; dome, 6Φ–40R tip Evaluation Scale ○: more than 1000 continuous weld points Δ: 500–1000 continuous weld points X: fewer than 500 continuous weld points (4) Workability Cup molding was carried out with a hydraulic molding tester using a 50-mm diameter cylindrical punch at a draft of 2.25. The test was carried out with oiling, and the wrinkle holding pressure was 500 kg. The workability was evaluated according to the following index.

Evaluation Scale

○: no anomalies

Δ: cracks in plating

X: peeling of plating

TABLE 2

Summary of plating levels

| No. | Plating layer composition Mg | Ca | Al | Zn | Si | Production conditions Cooling temperature (° C./sec) | Intermetallic compound massive bodies (in 1 mm) width field of plating layer cross-section) Mean long diameter (μm) | Number | Remarks |
|---|---|---|---|---|---|---|---|---|---|
| 1 | 0.5 | — | 0.5 | — | — | 16 | 3 | 3 | Invention Example |
| 2 | 1 | — | 0.5 | — | — | 16 | 4 | 12 | Invention Example |
| 3 | 2 | — | 0.5 | — | — | 16 | 4 | 13 | Invention Example |
| 4 | 3 | — | 1 | — | — | 16 | 5 | 13 | Invention Example |
| 5 | 5 | — | 3 | — | — | 16 | 5 | 16 | Invention Example |

TABLE 2-continued

Summary of plating levels

| No. | Plating layer composition Mg | Ca | Al | Zn | Si | Production conditions Cooling temperature (° C./sec) | Intermetallic compound massive bodies (in 1 mm) width field of plating layer cross-section) Mean long diameter (μm) | Number | Remarks |
|---|---|---|---|---|---|---|---|---|---|
| 6 | 1 | 0.05 | — | — | — | 16 | 3 | 12 | Invention Example |
| 7 | 2 | 0.1 | — | — | — | 16 | 4 | 14 | Invention Example |
| 8 | 2 | 0.03 | 0.2 | — | — | 16 | 4 | 14 | Invention Example |
| 9 | 2 | 0.03 | 0.2 | — | — | 30 | 0.5 | 13 | Invention Example |
| 10 | — | 1 | 1 | — | — | 16 | 3 | 12 | Invention Example |
| 11 | 1 | — | 0.5 | 8 | — | 16 | 2 | 12 | Invention Example |
| 12 | 1 | 0.05 | — | — | 0.2 | 16 | 3 | 13 | Invention Example |
| 13 | Sn | | | | | 16 | — | — | Comp. Ex. |
| 14 | Sn-8% Zn | | | | | 16 | — | — | Comp. Ex. |
| 15 | Pb-8% Sn | | | | | 16 | — | — | Comp. Ex. |

TABLE 3

Performance measurement results

| No. | Corrosion resistance Salt injury | After coating | Fuel | Exposure | Weldability | Workability | Overall evaluation | Remarks |
|---|---|---|---|---|---|---|---|---|
| 1 | ○ | ○ | ○ | ○ | ○ | ○ | ○ | Invention Example |
| 2 | ○ | ◎ | ○ | ○ | ○ | ○ | ◎ | Invention Example |
| 3 | ○ | ◎ | ○ | ○ | ○ | ○ | ◎ | Invention Example |
| 4 | ○ | ◎ | ○ | ○ | ○ | ○ | ◎ | Invention Example |
| 5 | ○ | ◎ | ○ | ○ | ○ | ○ | ◎ | Invention Example |
| 6 | ○ | ◎ | ○ | ○ | ○ | ○ | ◎ | Invention Example |
| 7 | ○ | ◎ | ○ | ○ | ○ | ○ | ◎ | Invention Example |
| 8 | ○ | ◎ | ○ | ○ | ○ | ○ | ◎ | Invention Example |
| 9 | ○ | ○ | ○ | ○ | ○ | ○ | ○ | Invention Example |

TABLE 3-continued

| | Performance measurement results | | | | | | | |
|---|---|---|---|---|---|---|---|---|
| | Corrosion resistance | | | | | | Overall | |
| No. | Salt injury | After coating | Fuel | Exposure | Weld-ability | Work-ability | evalua-tion | Remarks |
| 10 | ○ | ◎ | ○ | ○ | ○ | ○ | ◎ | Invention Example |
| 11 | ○ | ◎ | ○ | ○ | ○ | ○ | ◎ | Invention Example |
| 12 | ○ | ◎ | ○ | ○ | ○ | ○ | ◎ | Invention Example |
| 13 | x | ○ | Δ | x | ○ | ○ | x | Comp. Ex. |
| 14 | Δ | ○ | ○ | x | ○ | ○ | x | Comp. Ex. |
| 15 | x | ○ | Δ | x | ○ | ○ | x | Comp. Ex. |

Overall evaluation
◎ very excellent,
○ excellent,
Δ somewhat inferior but usable,
x unusable The Pb-8% Sn-plated steel sheet listed as No.15 which is widely used for conventional automobile fuel tanks and the Sn-plated steel sheet listed as No.13 had excellent corrosion resistance of the platings themselves, but there was no protective effect on the basis iron exposed at the edges or at the unplated sections. The Sn-8% Zn-plated steel sheet of No.14 showed improvement in this aspect, but it was insufficient.

In contrast, the invention examples of Nos. 1–12 had very excellent corrosion resistance. However, because No.1 had a low Mg content, and No.9 had a high cooling rate at the melting pot exit end and a small intermetallic compound grain size, their effects were insufficient.

Production of $Mg_2Sn$ and $Ca_2Sn$ was confirmed in all of the examples by X-ray diffraction and cross-sectional inclined polishing, and the excellent corrosion resistance of the invention examples was attributed to the passivation effect on the plating layer and basis iron due to dissolution of these water-soluble intermetallic compounds.

Example 2

Hot-dip aluminum plating was carried out using as materials cold-rolled steel sheets with the same steel components and sheet thicknesses as in Example 1.

The hot-dip aluminum plating was accomplished using a non-oxidizing furnace-reducing furnace type line, and the plating coverage was adjusted by gas wiping after plating, after which the sheet was cooled and subjected to zero spangle treatment. The composition of the plating bath was varied for production of different samples, and the properties were examined. Incidentally, the plating bath contained about 1–2% of Fe as an unavoidable impurity from the plating instruments and stripping. The bath temperature was 640–660° C. There was no particularly severe oxidation of Mg or Ca. Under some conditions (no addition of Ca, or no $N_2$ seal BOX), however, wrinkles were observed on the outer appearance. By modifying the sheet penetration temperature and the cooling rate after plating, it was possible to achieve a smaller alloy layer thickness, and the thickness achieved was 1.5–3 μm.

The plating coverage was approximately 60 g/m$^2$, uniformly on both sides. The surface roughness was 1.2–2.2 μm in terms of Ra.

Figure 3:
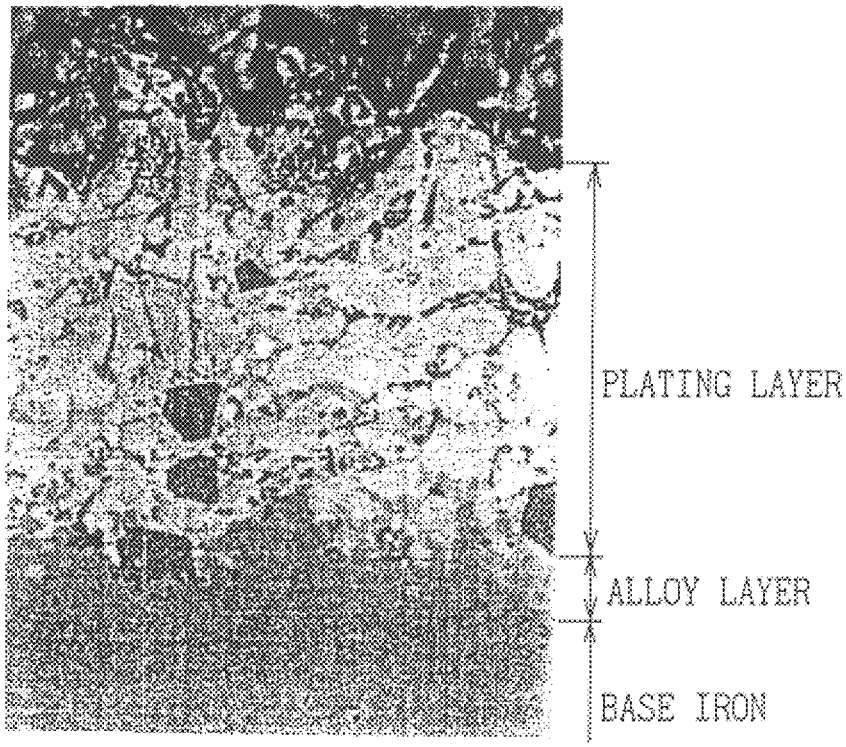
FIG. 3 is an illustration showing a 50 inclined cross-sectional structure of an Al-8% Si-6% Mg-plated steel sheet.

A 5° inclination cross-sectional structure with a plating layer composition of Al-8%Si-6%Mg-0.1%Ca is shown in FIG. 3. In the photograph of FIG. 3 (200×), the lower gray portion is the cross-section of the basis iron, the nearly white portion at the middle region is the cross-section of the plating layer (5° inclined cross-section), the unfocused top area is the surface of the plating layer, and at the interface between the basis iron and the plating layer there can be seen a thin alloy layer, though it is difficult to distinguish since its color is similar to that of the basis iron in this photograph. The $Mg_2Si$ massive bodies are seen as relatively dark gray triangular to hexagonal shapes in the white plating layer cross-section.

The short axes of the $Mg_2Si$ massive bodies of the sample produced here were 4–25 μm, the long axes were 6–30 μm, and the short diameter/long diameter ratios were 0.7–1. The $Mg_2Si$ was also present in a fine granular phase in addition to this massive structure. X-ray diffraction and EPMA analysis also confirmed the presence of $Mg_2Si$. The added Mg had been almost totally converted to Mg2Si, and was estimated to be present at about 9% in this plating layer composition.

For comparison, a conventional type of aluminum plating, i.e. Al-10% Si plating and a Galvalume steel sheet (Zn-55% Al-1.5% Si) were also produced. The coverage for these was 60 g/m2 on both sides.

(1) Plating Layer Analysis Method

[1] Plating Layer Composition Analysis Method

Both sides of a 50×50 sample were subjected to electrostripping in a 3% NaOH+1% $AlCl_3.6H_2O$ solution (wt %) at a current density of 20 mA/cm$^2$, using stainless steel as the counter electrode. Upon abrupt increase in the potential, the current density was gradually reduced to half, and then eventually reduced to 1 mA/cm$^2$, and electrolysis was suspended when the potential of the alloy layer was exhibited. Black scrap was produced because $Mg_2Si$, $Ca_2Si$, etc. are insoluble in such alkali solutions. Electrostripping was then repeated with 5% NaCl. The current density here was initially 10 mA/cm$^2$ and upon abrupt increase in the potential, the current density was gradually reduced to half and then to 1 MA/cm$^2$. The insoluble scrap was gently wiped from the steel sheet with absorbent cotton, and each absorbent cotton was used as a sample analysis solution. The analysis solution was then filtered and the undissolved scrap was dissolved in 10% hydrochloric acid. The filtrate and solution were combined and subjected to quantitative analysis by ICP (inductively coupled plasma) emission spectroscopy. Because error due to Cr, Si, etc. can occur when a steel sheet is subjected to chemical treatment, the stripping may be carried out after light paper polishing of the surface.

[2] Plating Composition Observation Method

The plating layer cross-section was polished at a 5° inclination, and the plating composition was observed (200–500×) with an optical microscope. The long diameter and number of the intermetallic compounds ($Mg_2Si$ massive bodies with long diameter/short diameter ratio ≧0.4) in the plating layer were measured within a 1 mm width (arbitrary) field of the plating.

(2) Corrosion Resistance Evaluation

[1] Salt Injury Corrosion Resistance

A salt spray test according to JIS Z2371 was carried out for 30 day on a 70×150 mm sample, and the corrosion product was stripped for measurement of the corrosion loss. The corrosion loss was expressed as a value with respect to one plated side.

Evaluation Scale

◎: corrosion loss of ≦5 g/m$^2$
○: corrosion loss of <10 g/m$^2$
Δ: corrosion loss of 10–25 g/m$^2$
X: corrosion loss of >25 g/m$^2$

[2] Post-painting Corrosion Resistance

Chromic acid/silica chemical treatment was carried out as chemical treatment to about 20 mg/m$^2$ in terms of metal Cr. This was followed by painting of a 70×150 mm sample with melamine-based black paint to 20 μm, and then 20 minutes of baking at 140° C. This was then cross-cut and provided for a salt spray test. The outer appearance after 60 days was visually evaluated.

Evaluation Scale

◎: no red rust generation
○: no red rust generation other than from cross-cut
Δ: red rust generation of ≦5%
X: red rust generation of >5%

[3] Fuel Corrosion Resistance

The corrosion resistance against gasoline was evaluated. The method involved placing a test solution in a sample subjected to deep drawing with a flat-bottomed cylinder having a 20 mm flange width, 50 mm diameter and 25 mm depth with a hydraulic molding tester, and capping it with glass via a silicon rubber ring. The state of corrosion after the test was visually observed.

Test Conditions

Test solution: gasoline+10% distilled water+200 ppm formic acid
Test period: standing for 3 months at 40° C.

Evaluation Scale

○: red rust generation of <0.1%
Δ: red rust generation of 0.1–5% or white rust
X: red rust generation of >5% or considerable white rust

[4] Corrosion Resistance Against Exhaust System Condensation

A 25×100 mm sample was used in a test according to JASOM611-92B of the Japan Automobile Technical Specifications. The test period was 4 cycles. After the test, the corrosion product was stripped and the corrosion depth was measured.

Evaluation Scale

○: corrosion depth of <0.05 mm
Δ: corrosion depth of 0.05–0.2 mm
X: corrosion depth of >0.2 mm

[5] Outdoor Exposure Test

Coating was carried out after the chemical treatment described above in [2]. The coating was with two types, a polyethylene wax-containing acrylic resin (clear: 5 μm) and an epoxy resin (20 μm). The sample was sheared to dimensions of 50×200 nm and subjected to an outdoor exposure test. After the course of 3 months, the generation of red rust from the edges and the condition of discoloration of the surface were evaluated.

Evaluation Scale

○: red rust generation of <30% from edges
Δ: red rust generation of 30–80% from edges
X: red rust generation of >80% from edges (3) Weldability After the chemical treatment described above in [2], spot welding was performed under the welding conditions indicated below, and the number of continuous weld points up to the time at which the nugget system cleared $4\sqrt{t}$ (t=sheet thickness) was evaluated.

Welding Conditions

Welding current: 10 kA
Pressure force: 220 kg
Welding time: 12 cycles
Electrode diameter: 6 mm
Electrode shape: dome, 6 Φ–40R tip Evaluation Scale ○: more than 700 continuous weld points
Δ: 400–700 continuous weld points
X: fewer than 400 continuous weld points (4) Workability cup molding was carried out with a hydraulic molding tester using a 50-mm diameter cylindrical punch at a draft of 2.25. The test was carried out with oiling, and the wrinkle holding pressure was 500 kg. The workability was evaluated according to the following index.

Evaluation Scale

○: no anomalies
Δ: cracks in plating
X: peeling of plating (5) Outer Appearance

The outer appearance was visually observed after plating.

Evaluation Scale

○: uniform outer appearance
Δ: thin wrinkled pattern
X: wrinkled pattern

TABLE 4

Summary of plating levels

| No. | Plating layer composition Si | Mg | Ca | Zn | Production conditions Cooling temperature (° C./sec) | Intermetallic compound massive bodies (in 1 mm width) field of plating layer cross-section) Mean long diameter (μm) | Number | Outer appearance | Remarks |
|---|---|---|---|---|---|---|---|---|---|
| 1 | 4 | 6 | 0.1 | — | 15 | 20 | 20 | good | Invention Example |
| 2 | 8 | 6 | 0.1 | — | 15 | 20 | 25 | good | Invention Example |
| 3 | 8 | 6 | — | — | 15 | 23 | 23 | wrinkled pattern | Invention Example |
| 4 | 8 | 3 | 0.1 | — | 5 | 30 | 8 | good | Invention Example |
| 5 | 8 | 6 | 0.1 | 5 | 15 | 20 | 19 | good | Invention Example |
| 6 | 8 | 6 | 0.1 | 12 | 15 | 20 | 20 | good | Invention Example |
| 7 | 8 | 6 | 0.1 | 23 | 15 | 21 | 20 | good | Invention Example |
| 8 | 10 | 6 | 5 | — | 15 | 24 | 2 | good | Invention Example |
| 9 | 12 | 8 | 0.5 | — | 15 | 26 | 25 | good | Invention Example |
| 10 | 14 | — | 10 | — | 15 | 25 | 16 | good | Invention Example |
| 11 | 10 | 2 | 3 | — | 15 | 13 | 15 | good | Invention Example |
| 12 | 12 | 6 | 0.1 | 14 | 15 | 23 | 23 | good | Invention Example |
| 13 | 8 | 6 | 0.1 | | 35 | 6 | 2 | good | Comp. Ex. |
| 14 | 9 | 6 | 0.1 | | 30 | 7 | 10 | good | Comp. Ex. |
| 15 | 10 | 6 | 0.1 | 15 | 35 | 6 | 6 | good | Comp. Ex. |
| 16 | Al-10Si | | | | 30 | — | — | good | Comp. Ex. |
| 17 | Zn-55Al-1.5Si | | | | 25 | — | — | good | Comp. Ex. |

TABLE 5

Performance evaluation results

| No. | Corrosion resistance Salt injury | After coating | Fuel | Exhaust system | Exposure | Weldability | Workability | Outer appearance | Overall evaluation | Remarks |
|---|---|---|---|---|---|---|---|---|---|---|
| 1 | ○ | ○ | ○ | ○ | ○ | ○ | ○ | ○ | ○ | Invention |
| 2 | ○ | ○ | ○ | ○ | ○ | ○ | ○ | ○ | ○ | Example |
| 3 | ○ | ○ | ○ | ○ | ○ | ○ | ○ | x | Δ | |
| 4 | ○ | Δ | ○ | ○ | Δ | ○ | ○ | ○ | Δ | |
| 5 | ○ | ◎ | ○ | ○ | ○ | ○ | ○ | ○ | ◎ | |
| 6 | ○ | ◎ | ○ | ○ | ○ | ○ | ○ | ○ | ◎ | |
| 7 | ○ | ◎ | ○ | ○ | ○ | ○ | ○ | ○ | ◎ | |
| 8 | ○ | ○ | ○ | ○ | ○ | ○ | ○ | ○ | ○ | |
| 9 | ○ | ○ | ○ | ○ | ○ | ○ | ○ | ○ | ○ | |
| 10 | ○ | ○ | ○ | ○ | ○ | ○ | ○ | ○ | ○ | |
| 11 | ○ | Δ | ○ | ○ | Δ | ○ | ○ | ○ | Δ | |
| 12 | ○ | ◎ | ○ | ○ | ○ | ○ | ○ | ○ | ◎ | |
| 13 | ○ | x | ○ | ○ | Δ | ○ | ○ | ○ | x | Comp. Ex. |
| 14 | ○ | x | ○ | ○ | Δ | ○ | ○ | ○ | x | |
| 15 | ○ | x | ○ | ○ | Δ | ○ | ○ | ○ | x | |

TABLE 5-continued

| | Performance evaluation results | | | | | | | | | |
|---|---|---|---|---|---|---|---|---|---|---|
| | Corrosion resistance | | | | | | | Outer | Overall | |
| No. | Salt injury | After coating | Fuel | Exhaust system | Exposure | Weldability | Workability | appearance | evaluation | Remarks |
| 16 | Δ | x | ○ | ○ | x | ○ | ○ | ○ | x | |
| 17 | x | x | Δ | Δ | Δ | ○ | ○ | ○ | x | |

Overall evaluation
⊙ very excellent,
○ excellent,
Δ somewhat inferior but usable,
x unusable

Industrial Applicability the present invention provides surface treated steel sheets with high corrosion resistance of Sn-based platings and Al-based platings themselves which has not been achievable by the prior art, while also providing an anti-corrosion effect on the edges and damaged sections. Because they can be used for virtually any type of conventional surface treated steel sheet, a very considerable industrial contribution is provided.

What is claimed is:

1. A tin-plating surface treated steel material with excellent corrosion resistance, characterized by containing an intermetallic compound composed of one or more Group IIa (alkaline earth metal) elements and one or more Group IVb elements in a tin-based plating layer on the surface of a steel material.

2. A tin-plating surface treated steel material with excellent corrosion resistance according to claim 1, wherein said intermetallic compound is a compound composed of at least one element of Mg and Ca of Group IIa and at least one element of Si and Sn of Group IVb.

3. A tin-plating surface treated steel material with excellent corrosion resistance according to claim 1 wherein said intermetallic compound is in the form of massive bodies with a long diameter of 1 μm or greater and a short diameter/long diameter ratio of 0.4 or greater.

4. A tin-plating surface treated steel material with excellent corrosion resistance according to claim 1, wherein the component composition of said tin-based plating layer is, in terms of weight percentage, either or both Mg and Ca in ranges of Mg: 0.2–10% and Ca: 0.01–10%, with the remainder Sn and unavoidable impurities.

5. A tin-plating surface treated steel material with excellent corrosion resistance according to claim 1, wherein the component composition of said tin-based plating layer is, in terms of weight percentage, either or both Mg and Ca in ranges of Mg: 0.2–10% and Ca: 0.01–10%, with Al in the range of 0.01–10%, and the remainder Sn and unavoidable impurities.

6. A tin-plating surface treated steel material with excellent corrosion resistance according to claim 4, wherein said tin-based plating layer further contains, in terms of weight percentage, Zn: 1–40% and/or Si: 0.1–0.5%.

7. A tin-plating surface treated steel material with excellent corrosion resistance according to claim 1, wherein the thickness of the plating layer on the steel material surface is 2–100 μm.

8. A tin-plating surface treated steel material with excellent corrosion resistance according to claim 1, wherein the roughness of the plating surface is no greater than 3 μm in terms of Ra.

9. A tin-plating surface treated steel material with excellent corrosion resistance according to claim 1, wherein an alloy layer with a thickness of no greater than 5 μm is present at the interface between the plating layer and the steel material.

10. A tin-plating surface treated steel material with excellent corrosion resistance according to claim 1, having at least one of a pre-plating layer containing one or more from among Ni, Co, Zn, Sn, Fe and Cu, an alloy layer of said pre-plating layer and the basis iron, and an alloy layer of said pre-plating layer and the plating layer.

11. A tin-plating surface treated steel material with excellent corrosion resistance according to claim 1, containing one or more added elements from among Ni, Co, Zn, Sn, Cu, Bi, Sb, misch metal, Fe, Be, Cr and Mn, as a plating layer component.

12. A tin-plating surface treated steel material with excellent corrosion resistance accordance to claim 1, having a post-treatment coating on the uppermost surface of the steel material.

* * * * *